United States Patent [19]

Merlone

[11] Patent Number: 4,953,376

[45] Date of Patent: Sep. 4, 1990

[54] METAL SPINNING PROCESS AND APPARATUS AND PRODUCT MADE THEREBY

[76] Inventor: John C. Merlone, 50 Old Hill Rd., Hamden, Conn. 06514

[21] Appl. No.: 349,217

[22] Filed: May 9, 1989

[51] Int. Cl.[5] ..... B21D 17/04

[52] U.S. Cl. ..... 72/57; 72/84; 72/110; 72/466

[58] Field of Search ..... 72/84, 94, 102, 105, 72/106, 107, 108, 110, 111, 465, 466, 57; 101/7, 38.1

[56] References Cited

U.S. PATENT DOCUMENTS

| | | | |
|---|---|---|---|
| 681,960 | 9/1901 | Flanigan . | |
| 3,031,993 | 5/1962 | Gerard et al. . | |
| 3,180,130 | 4/1965 | Avera . | |
| 3,260,089 | 7/1966 | Hazelton et al. . | |
| 3,279,237 | 10/1966 | Rader | 72/466 |
| 3,680,350 | 8/1972 | Pavleszek et al. . | |
| 3,698,337 | 10/1972 | Brawner et al. | 72/41 |
| 3,808,868 | 5/1974 | Wolfe . | |
| 3,951,083 | 4/1976 | Hortig . | |
| 4,044,667 | 8/1977 | Jackson | 101/38.1 |
| 4,183,124 | 1/1980 | Hoffman . | |
| 4,606,207 | 8/1986 | Slade | 72/110 |
| 4,723,430 | 2/1988 | Hahn . | |

FOREIGN PATENT DOCUMENTS

| | | | |
|---|---|---|---|
| 199138 | 11/1984 | Japan | 72/105 |

OTHER PUBLICATIONS

Photographs and Drawings of Commercially Available Apparatus and Processes.

*Primary Examiner*—Lowell A. Larson

*Attorney, Agent, or Firm*—Mattern, Ware, Stoltz & Fressola

[57] ABSTRACT

In a metal spinning process and apparatus for necking down a container having an open end, a closed end and generally cylindrical inner and outer surfaces, a resilient pressure bladder is inserted into the container prior to the necking down operation. Pressure is maintained in the bladder throughout the operation to prevent crumpling of the container body. The invention is particularly useful on thin walled, deep drawn steel containers.

42 Claims, 3 Drawing Sheets

METAL SPINNING PROCESS AND APPARATUS AND PRODUCT MADE THEREBY

BACKGROUND OF THE INVENTION

The invention relates generally to metal spinning processes and apparatus and products made thereby, and more particularly to metal spinning processes and apparatus forming necked-down portions on thin walled, deep drawn, seamless steel cans.

Two commercially available processes and apparatus have been used to form necked down portions on aluminum cans, such as twelve ounce (12 oz.) soda cans, to provide suitable flange area for attaching a cover or lid and the well known six ring plastic carrying device.

The first process and apparatus, developed by Metal Box Company of England, uses two metal forming roller tools, a rotating chuck and rotating baseplate to form the neck-downed portion of the cans. A prenecked can is placed on the baseplate and clamped into position by the chuck. Compressed air is pumped into the can. The assembly is rotated at high speed and moves axially as the roller tools move inwardly forming the neck. As the baseplate moves away from the chuck, the can slips off the chuck thereby producing the familiar flange on the neck found on such cans. Prenecked cans are required by this process and are often die necked. However, prenecked cans formed by metal spinning are often used as well.

The other process is called a "spin flow" process. The neck of the can is formed in a single operation but a second operation is needed to flatten the flange to the desired angle. This process uses one metal forming roller tool, and a rotating baseplate with a slide roll (chuck) and an eccentric roll inside the can being formed.

While these two commercially available processes and apparatus work satisfactorily to produce cans from aluminum which is an easily formable material, they have not proved effective in producing necked-down portions on thin walled, deep drawn, seamless steel cans for use as, for example, aerosol cans for hair spray and the like. In addition, the material cost for an aluminum can is dramatically more expensive than that for a steel can so substantial savings can be achieved by using steel cans rather than aluminum cans.

Heretofore, metal spinning of such thin walled, deep drawn, seamless steel cans has been done using a metal insert within the can to be formed to prevent wrinkling of the can as it is worked by the metal forming roller tool. The metal insert has the desired final shape of the can and is made in a plurality of wedge shaped segments which can be manipulated and removed from the finished can. While this type of metal insert has been satisfactorily used to form necked-down portion on steel cans, it is time consuming and difficult to manipulate the wedge shaped segments from the finished can.

The present invention is designed to overcome the above noted limitations that are attendant upon the use of the "prior art" devices, and toward this end, it contemplates the provision of a novel metal method spinning method and apparatus for producing a necked-down portion on metal containers.

It is an object of the present invention to provide a novel method and apparatus using a pressure regulated bladder inserted within the container being formed during the forming of the necked-down portion thereof.

It is also an object to provide such a method and apparatus which can form the desired necked-down portion on the container in a expedited manner.

Still another object is to provide such a method and apparatus in which the containers are necked-down in a single operation without the need for prenecked cans.

An additional object is to provide such a method and apparatus which operates on thin walled, deep drawn seamless steel cans to form a necked-down portions thereon.

A further object is to provide a novel container made by the novel method and apparatus of the present invention. The novel container can be readily and economically fabricated and will enjoy a long life in service.

SUMMARY OF THE INVENTION

It has now been found that the foregoing and related objects can be readily obtained in a process and apparatus for forming a surface configuration on a metal container body having an open end, a closed end and generally cylindrical inner and outer surfaces. The apparatus is provided with a resilient pressure bladder insertable through the open end of the container body and into contact with the inner surface thereof and a bladder positioning device for manipulating the resilient pressure bladder to insert and remove the same through the open end of the container body. The bladder insert has a shape identical to the shape of the metal container body.

During the forming process, the container body and resilient pressure bladder are rotated together around their longitudinal axes. A metal forming tool with a forming portion thereon is spaced from the outer surface of the container and then moved so the forming portion engages and deforms the container to produce a desired shape thereon thereby deforming the resilient pressure bladder therein.

Desirably, during its insertion, the resilient pressure bladder can be pressurized which forces the resilient pressure bladder into positive engagement with the inner surface of the container body for rotation therewith. The pressurizing step can include maintaining uniform pressure in the resilient pressure bladder when the tool is in operation.

Conveniently, a clamping device holds the metal container body with its longitudinal axis in a vertical position. The clamping device holds the container body by its closed end leaving the open end free to accept the resilient pressure bladder.

Preferably, the metal container body is a thin walled, deep drawn seamless steel container. The steel container may be at least six inches (6") long having an inner diameter more than two inches (2") and a wall thickness less than seven thousandths of an inch (0.007").

In accordance with the invention, a power source positively rotates the container body which in turn rotates the resilient pressure bladder therewith. The container body and resilient pressure bladder are rotatable in the range of 1000 to 5000 rpm.

In yet another feature of the the invention, the forming portion of the metal forming tool is a roller rotatable around an axis parallel to the axis of the container body. The apparatus can also include a second metal forming tool, similar to the first forming tool, having a forming portion thereon spaced from the outer surface of the container and acting in conjunction with the first forming tool during the forming step. The forming portions of the metal forming tools are diametrically opposed to one another on either side of the container body.

The invention will be fully understood when reference is made to the following detailed description taken in conjunction with the accompanying drawings.

DETAILED DESCRIPTION OF THE PREFERRED EMBODIMENT

Figure 1:
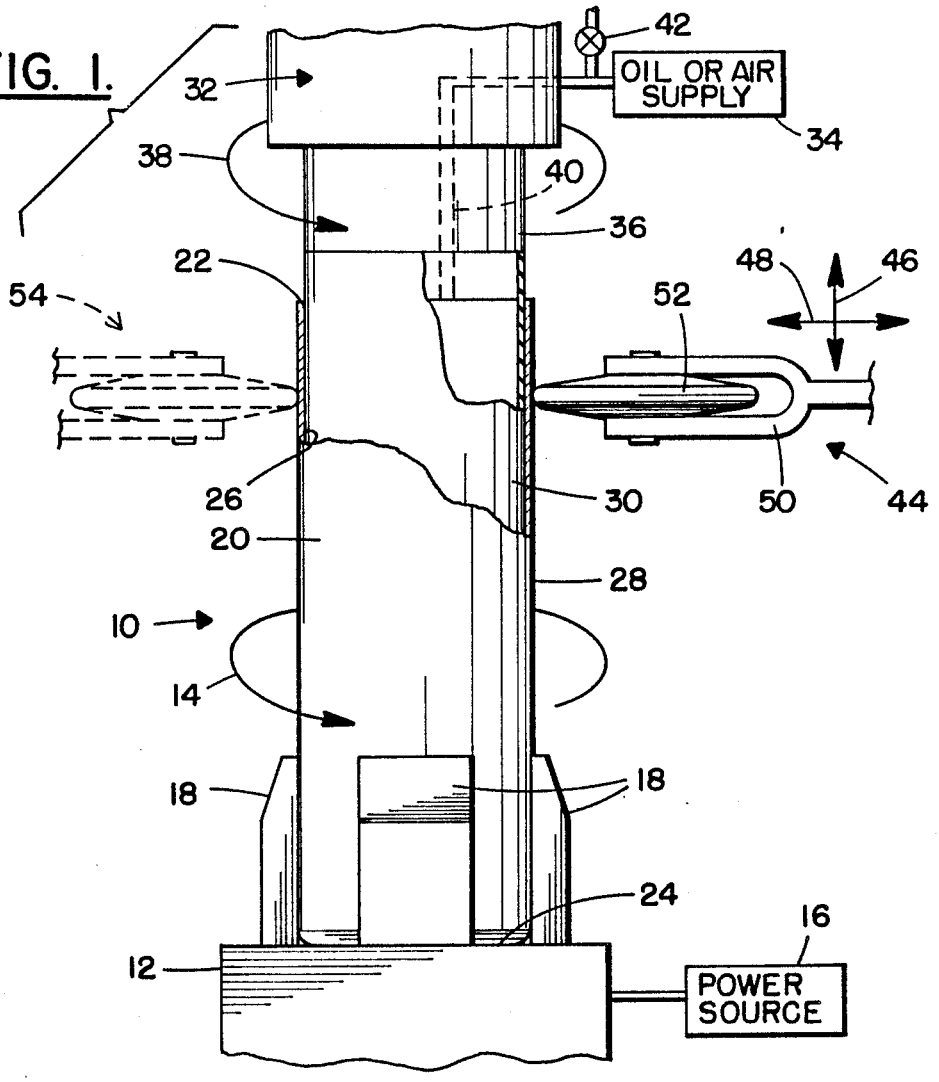
FIG. 1 is a partial side elevational view of the metal spinning apparatus of the present invention with portions broken away to reveal internal structure and one of the metal forming roller tools shown in dotted line.
Figure 2:
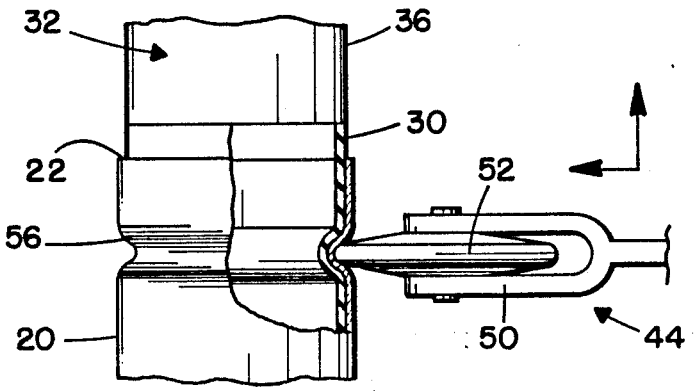
FIG. 2 is a partial side elevational view of the apparatus of FIG. 1 showing the metal forming roller tool moving radially against the outer surface of the container to deform the same.

Turning first to FIG. 1 of the drawings, therein illustrated is a metal spinning machine of the present invention generally indicated by the numeral 10. The machine 10 has a base chuck 12 which is powered for rotation as indicated by arrow 14 about its longitudinal axis by an appropriate power source 16. The chuck has four reciprocating clamping jaws 18 (three are shown) which are used to clamp a thin walled, deep drawn, seamless steel container 20 for rotation therewith.

The container 20 has an open end 22, a closed end 24 seated on the base chuck 12 and clamped by the clamping jaws 18, and a generally cylindrical shape with cylindrical inner and outer surfaces 26 and 28, respectively. While the present method and apparatus is generally applicable to all sizes of containers, the container 20 shown is six inches (6") long having an inner diameter of two inches (2") and a wall thickness of six thousands of an inch (0.006"). As can be seen in FIG. 1, the container 20 has not been prenecked prior to the forming step.

Inserted within the container 20 through its open end 22 is a resilient pressure bladder 30. The resilient bladder 30 is made of neoprene synthetic rubber material having a thickness of about one thirty second of an inch (1/32") and, in its pressurized state, has the same surface configuration as the undeformed inner surface 26 of the container 20. Holding the resilient pressure bladder 30 in place is a bladder positioning device generally indicated by the numeral 32 which is connected to an oil or air supply 34 for pressurizing the resilient pressure bladder 30. The bladder positioning device 32 has a rotatable portion 36 permitting the resilient pressure bladder 30 to rotate with the base chuck 12 and container 20 as indicated by arrow 38. The oil or air supply 34 communicates with the resilient pressure bladder 30 through a conduit 40 extending through the bladder positioning device 32. The conduit 40 has a relief valve 42 in the event the pressure in the bladder 30 rises to undesirably high levels.

A first forming roller tool generally indicated by the numeral 44 is mounted on the right hand side of the container body 20 for movement axially and radially as indicated by arrows 46, 48. The forming roller tool 44 is comprised of a tool holder 50 with a freely rotatable forming portion 52 which is rotatably held thereby. The forming portion 52 rotates around its axis when it engages the rotating container 20. If desired, a second forming roller tool, shown in dotted line and generally indicated by numeral 54, can be mounted diametrically opposed the first forming roller tool 44. The second forming roller tool 54 is identical in both form and operation to the first forming roller tool 44.

As will be more clearly understood when considering FIGS. 2–5 taken in conjunction with FIG. 1, the method of the present invention for forming a necked-down portion on the container 20 involves clamping the container body 20 in place and inserting the resilient pressure bladder 30 through the open end 22 of the container body 20 and into contact with the inner surface 26 thereof. The insertion step is accomplished by axial movement of the bladder positioning device 32 until the bladder 30 is fully inserted in the desired position within the container 20. Following such insertion, the oil or air supply 34 fully pressurizes the resilient pressure bladder 30 so it positively engages with the inner surface 26 of the container body 20. Thereinafter, the oil or air supply 34 is cut off from the bladder 30; however, the relief valve 42 prevents pressure in the bladder from building to undesirably high levels. It is also contemplated that the oil or air supply 34 could be used to maintain uniform pressure within the pressure bladder throughout the entire forming process.

Once the bladder 30 is inserted in the container 20 and pressurized, the power source 16 then begins to rotate the base chuck 12 at a constant speed in the range of 1000–5000 rpm. Since the resilient pressure bladder 30 is engaged with the inner surface 26 of the container 20 and held by the free wheeling rotatable portion 36 of the bladder holder 32, the bladder 30 rotates together with the container 20 at the same constant rpm.

Figure 4A:
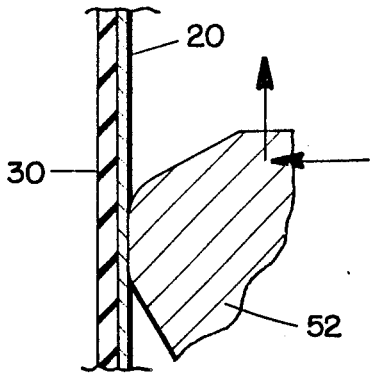
FIGS. 4A–4E are enlarged cross-sectional views of a portion of the tool, container body and bladder in operational sequence performing the necking-down method of the present invention.
Figure 4B:
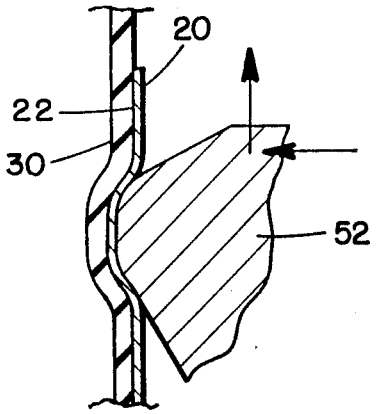
Figure 4C:
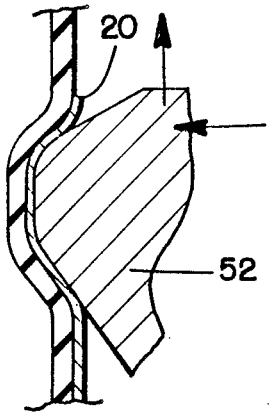
Figure 4D:
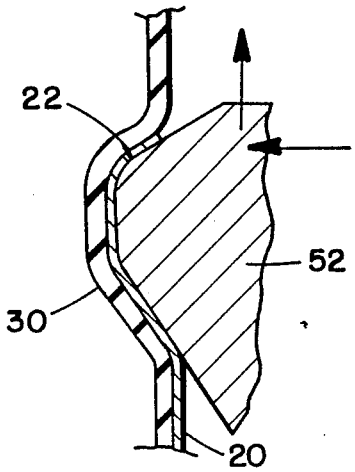
Figure 4E:
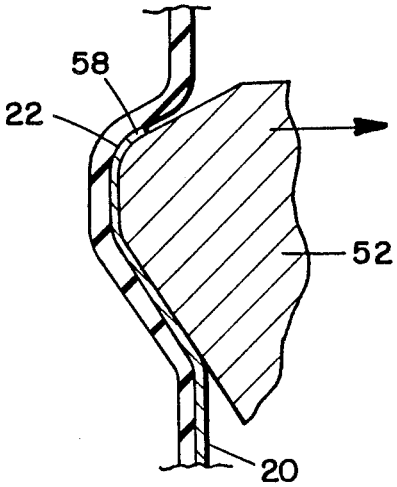

To deform the container 20 and thereby form the desired necked-down portion, the forming roller tool 44 is moved radially inwardly toward the longitudinal axis of the container 20 and the bladder 30. As it is moved, the roller tool 44 deforms both the container 20 and the bladder 30 therein as indicated necked-down portion 56. The tool 44 continues to move radially inwardly and is also moved axially along the outer surface 28 of the container 20 toward the open end 22 as shown in FIGS. 4B–4D. When the roller tool 44 reaches the FIG. 4E position, it is withdrawn from the deformed container 20 leaving a slight flange 58 on the open end 22 thereof. As artisans skilled in the art will appreciate, the base chuck 12, container 20 and bladder positioning device 32 could be moved axially and even radially to achieve the deforming operation rather than moving the forming tool 44.

Figure 5:
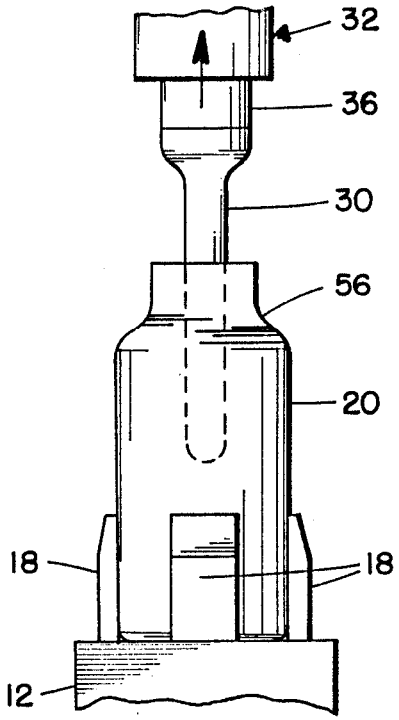
FIG. 5 is a partial side elevational view of the present invention with the bladder deflated and being removed from the open end of the necked-down container.

Once the roller tool 44 is withdrawn, the rotation of the container 20 can be stopped. The resilient pressure bladder 30 can then be deflated as shown in FIG. 5 and the bladder positioning device 32 moved axially to remove the resilient pressure bladder 30 from the container 20. The container 20 can then be removed from the base chuck 12 and a new container placed and clamped in position so the cycle can be repeated. The entire cycle takes about ten (10) seconds.

Figure 6:
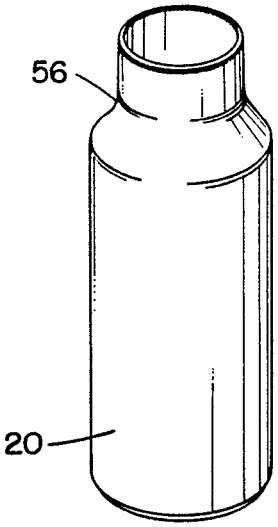
FIG. 6 is a perspective view of the container formed by the present invention.
Figure 7:
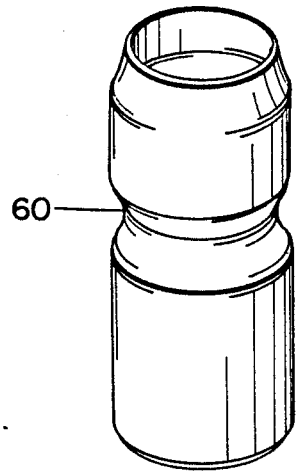
FIGS. 7–8 are perspective views of various other container configurations which can be formed using the apparatus and method of the present invention.
Figure 8:
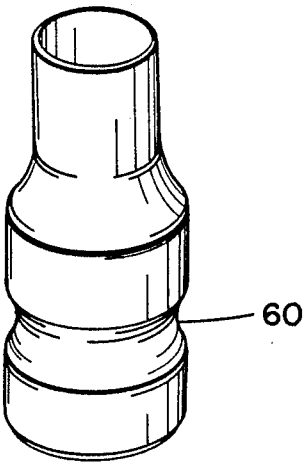

FIG. 6 shows a completed container 20 formed by the present invention with its necked-down portion 56. FIGS. 7 and 8 show various other containers which can be formed by the apparatus and method of the present invention. It should be noted that various configurations can be made including indentations 60 along the surface of the container at different points thereon in addition to the necked-down portions of the containers.

It should be recognized that the sequential operation of the present invention can be manually controlled or controlled by means of a numerical or tape controller (not shown). In addition, it should be appreciated that the apparatus of the present invention can be a multistation machine producing a plurality of necked-down containers simultaneously.

Figure 3:
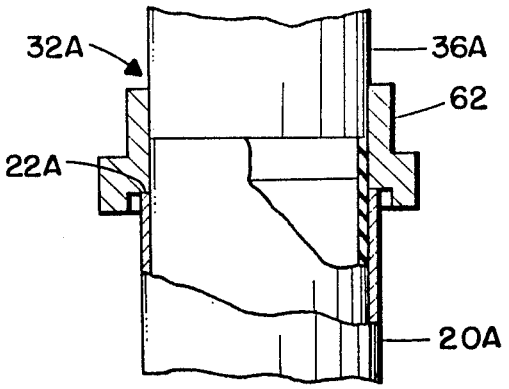
FIG. 3 is a partial side elevational view of a second embodiment of the present invention with the portions broken away to reveal internal structure.

FIG. 3 shows a second embodiment of the present invention which shows an outer circular flange or cap member 62 which is mounted on the rotatable portion 36A of the bladder positioning device 32A. The cap member 62 abuts the open end 22A of the container 20A for the purpose of locating, positioning and holding the top of the container 20A during the forming operation.

Thus, it can be seen from the foregoing specification attached drawings that the metal spinning method and apparatus of the present invention provides an effective means for necking down various portions of a thin walled, deep drawn steel container.

The preferred embodiments described above admirably achieve the objects of the invention; however, it will be appreciated that departures can be made by those skilled in the art without departing from the spirit and scope of the invention which is limited only by the following claims.

Having thus described the invention, what is claimed is:

1. A process for forming a surface configuration on a metal container body comprising the steps of:

providing a metal container body having an open end, a closed end and generally cylindrical inner and outer surfaces;

inserting a resilient pressure means through said open end of said container body and into contact with said inner surface thereof;

rotating said container body and said resilient pressure means together around their longitudinal axes;

providing a metal forming tool with a forming portion thereon spaced from said outer surface of said container;

providing relative movement between said forming portion of said metal forming tool and said rotating container body so said forming portion engages and deforms said container to produce a desired shape thereon and deforms said resilient pressure means therein; and removing said resilient pressure means through open end of said container body.

2. The process for forming a surface configuration on a metal container body in accordance with claim 1, wherein said inserting step includes the step of pressurizing said resilient pressure means.

3. The process for forming a surface configuration on a metal container body in accordance with claim 2, wherein said pressuring step forces said resilient pressure means into positive engagement with said inner surface of said container body for rotation therewith.

4. The process for forming a surface configuration on a metal container body in accordance with claim 2, wherein said pressuring step includes maintaining uniform pressure in said resilient pressure means throughout the relative movement step.

5. The process for forming a surface configuration on a metal container body in accordance with claim 1, wherein said resilient pressure means is a bladder insert.

6. The process for forming a surface configuration on a metal container body in accordance with claim 5, wherein said bladder insert has a shape identical to the shape of the metal container body provided during said metal container body providing step.

7. The process for forming a surface configuration on a metal container body in accordance with claim 1, wherein said metal container body providing step includes the step of clamping said metal container body with its longitudinal axis in a vertical position.

8. The process for forming a surface configuration on a metal container body in accordance with claim 7, wherein said clamping step including clamping said container body on said closed end leaving said open end free to accept said resilient pressure means.

9. The process for forming a surface configuration on a metal container body in accordance with claim 1, wherein said metal container body is a thin walled, deep drawn seamless steel container.

10. The process for forming a surface configuration on a metal container body in accordance with claim 9, wherein said thin walled, deep drawn seamless container is at least six inches (6″) long having an inner diameter more than two inches (2″) and a wall thickness less than seven thousandths of an inch (0.007″).

11. The process for forming a surface configuration on a metal container body in accordance with claim 10, wherein said rotating step includes said container being positively rotated by means of a power source which in turn rotates said resilient pressure means therewith.

12. The process for forming a surface configuration on a metal container body in accordance with claim 1, wherein said container body and resilient pressure means are rotated in the range of 1000 to 5000 rpm.

13. The process for forming a surface configuration on a metal container body in accordance with claim 1, wherein said forming portion of said metal forming tool is a roller rotatable around an axis parallel to the axis of said container body.

14. The process for forming a surface configuration on a metal container body in accordance with claim 1, wherein said metal forming tool providing step includes providing a pair of metal forming tools, each having a forming portion thereon spaced from said outer surface of said container.

15. The process for forming a surface configuration on a metal container body in accordance with claim 14, wherein said forming portions of said metal forming tools are diametrically opposed to one another on either side of said container body.

16. The process for forming a surface configuration on a metal container body in accordance with claim 1, wherein said relative movement is movement of said forming portion radially inwardly toward the longitudinal axis of said container body.

17. The process for forming a surface configuration on a metal container body in accordance with claim 16, wherein said relative movement is movement of said forming portion along said outer surface of said container in a longitudinal direction.

18. The process for forming a surface configuration on a metal container body in accordance with claim 16, wherein said relative movement is axial movement of said rotating container body and said resilient pressure means relative to said forming portion of said metal forming tool.

19. The process for forming a surface configuration on a metal container body in accordance with claim 1, further including the step of stopping said rotating step between said relative movement step and said removal step.

20. The process for forming a surface configuration on a metal container body in accordance with claim 1, wherein said removal step includes removing pressure in said resilient pressure means to facilitate removal of said container body.

21. An apparatus for forming a surface configuration on a metal container body comprising:

means providing a metal container body having an open end, a closed end and generally cylindrical inner and outer surfaces;

a resilient pressure means insertable through said open end of said container body and into contact with said inner surface thereof;

means for rotating said container body and said resilient pressure means together around their longitudinal axes;

a metal forming tool with a forming portion thereon spaced from said outer surface of said container;

means for providing relative movement between said forming portion of said metal forming tool and said container body so said forming portion engages and deforms said container to produce a desired shape thereon and deforms said resilient pressure means therein; and means for manipulating said resilient pressure means to insert and remove the same through said open end of said container body.

22. The apparatus for forming a surface configuration on a metal container body in accordance with claim 21, further including means for pressurizing said resilient pressure means.

23. The apparatus for forming a surface configuration on a metal container body in accordance with claim 22, wherein said means for pressurizing forces said resilient pressure means into positive engagement with said inner surface of said container body for rotation therewith.

24. The apparatus for forming a surface configuration on a metal container body in accordance with claim 22, wherein said means for pressurizing includes means for maintaining uniform pressure in said resilient pressure means when said means for providing relative movement is in operation.

25. The apparatus for forming a surface configuration on a metal container body in accordance with claim 21, wherein said resilient pressure means is a bladder insert.

26. The apparatus for forming a surface configuration on a metal container body in accordance with claim 25, wherein said bladder insert has a shape identical to the shape of the metal container body provided by said metal container body providing means.

27. The apparatus for forming a surface configuration on a metal container body in accordance with claim 21, wherein said metal container body providing means includes means for clamping said metal container body with its longitudinal axis in a vertical position.

28. The apparatus for forming a surface configuration on a metal container body in accordance with claim 27, wherein said clamping means provides for clamping said container body on said closed end leaving said open end free to accept said resilient pressure means.

29. The apparatus for forming a surface configuration on a metal container body in accordance with claim 21, wherein said metal container body is a thin walled, deep drawn seamless steel container.

30. The apparatus for forming a surface configuration on a metal container body in accordance with claim 29, wherein said thin walled, deep drawn seamless steel container is at least six inches (6") long having an inner diameter more than two inches (2") and a wall thickness less than seven thousandths of an inch (0.007").

31. The apparatus for forming a surface configuration on a metal container body in accordance with claim 36, wherein said rotating means includes a power source for positively rotating said container which in turn rotates said resilient pressure means therewith.

32. The apparatus for forming a surface configuration on a metal container body in accordance with claim 21, wherein said container body and resilient pressure means are rotatable in the range of 1000 to 5000 rpm.

33. The apparatus for forming a surface configuration on a metal container body in accordance with claim 21, wherein said forming portion of said metal forming tool is a roller rotatable around an axis parallel to the axis of said container body.

34. The apparatus for forming a surface configuration on a metal container body in accordance with claim 21, further including a second metal forming tool having a forming portion thereon spaced from said outer surface of said container.

35. The apparatus for forming a surface configuration on a metal container body in accordance with claim 34, wherein said forming portions of said metal forming tools are diametrically opposed to one another on either side of said container body.

36. The apparatus for forming a surface configuration on a metal container body in accordance with claim 21, wherein said relative movement means provides movement of said forming portion radially inwardly toward the longitudinal axis of said container body.

37. The apparatus for forming a surface configuration on a metal container body in accordance with claim 36, wherein said relative movement means provides movement of said forming portion along said outer surface of said container in a longitudinal direction.

38. The apparatus for forming a surface configuration on a metal container body in accordance with claim 36, wherein said relative movement means provides axial movement of said rotating container body and said resilient pressure means relative to said forming portion of said metal forming tool.

39. The apparatus for forming a surface configuration on a metal container body in accordance with claim 21, wherein said forming portion of said metal forming tool is a roller.

40. The apparatus for forming a surface configuration on a metal container body in accordance with claim 21, wherein said manipulating means is a positioning device for said resilient pressure means, at least a portion of which is rotatable with said resilient pressure means.

41. The apparatus for forming a surface configuration on a metal container body in accordance with claim 40, wherein said position device is axially moveable to insert and remove said resilient pressure means.

42. The apparatus for forming a surface configuration on a metal container body in accordance with claim 40, further including a conduit which extends through said positioning means communicating with said resilient pressure means for pressurizing the same.

* * * * *